US007435103B2

(12) United States Patent
Ma

(10) Patent No.: US 7,435,103 B2
(45) Date of Patent: Oct. 14, 2008

(54) BALL GRID ARRAY SOCKET HAVING A POSITIONING DEVICE

(75) Inventor: Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/982,963

(22) Filed: Nov. 6, 2007

(65) Prior Publication Data

US 2008/0108237 A1 May 8, 2008

(30) Foreign Application Priority Data

Nov. 6, 2006 (TW) ..... 95219530 U

(51) Int. Cl.
*H01R 12/00* (2006.01)

(52) U.S. Cl. ..... 439/71

(58) Field of Classification Search ..... 439/71, 439/70, 66, 342, 246
See application file for complete search history.

(56) References Cited

U.S. PATENT DOCUMENTS 6,626,683 B2 * 9/2003 Lai ..... 439/73
7,044,765 B1 * 5/2006 Lee et al. ..... 439/354
7,207,808 B2 * 4/2007 Ma ..... 439/71
7,234,946 B2 * 6/2007 Hsieh ..... 439/71
7,364,467 B2 * 4/2008 Chen et al. ..... 439/633
7,367,822 B2 * 5/2008 Ma ..... 439/135

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector (2) comprises an insulative housing (4) and a number of metal plates (3). The insulative housing (4) has a bottom floor (45) and a number of side walls (46) extending perpendicularly from the bottom floor (45). The bottom floor (45) and the side walls (46) define a cavity (44) and an opening opposite the bottom floor (45) so that a chipset (8) could be loaded into the cavity (44) through the opening. Each of the metal plates (3) comprises a base portion (30) fixing the metal plate (3) to the insulative housing (4), a spring arm (31) extending from the base portion (30) and a pressing pad (32) connecting the spring arm (31) for flexibly abutting a side of the chipset (8).

16 Claims, 5 Drawing Sheets

BALL GRID ARRAY SOCKET HAVING A POSITIONING DEVICE

BACKGROUND OF THE INVENTION

1. Field of the Invention

The present invention relates to an electrical connector, and more particularly, relates to an electrical connector having a device for positioning an electrical element received in the electrical connector.

2. Description of the Prior Art

An electrical connector 9 related to present invention is disclosed in FIG. 1. The electrical connector 9 includes an insulative housing 10 and a grid array of conductive contacts 110 received in the insulative housing 10. The insulative housing 10 forms a base portion 13 and four side walls 12 to define a cavity 15 for receiving a chipset 8. Adjacent two of the side walls 12 respectively form spring arms 120, 120' for flexibly abutting the chipset 8 against the corresponding side walls 12. However, the insulative housing 10 is difficult to be integrally injection-molded. Furthermore, the spring arms 120, 120' are integrally made from polymer, so, when the chipset 8 is loaded and unloaded in more circles, the spring arms 120 may become tired or even broken from the side walls 12 so that the chipset 8 can not be positioned in the right place in the cavity 15.

BRIEF SUMMARY OF THE INVENTION

Therefore, one object of the present invention is to provide a electrical connector having durable positioning device.

An electrical connector according to the present invention comprises an insulative housing having a bottom floor and a plurality of side walls extending perpendicularly from the bottom floor, the bottom floor and the side walls defining a cavity and an opening opposite the bottom floor so that an electrical element could be uploaded into the cavity through the opening; a metal plate, the metal plate comprising a base portion fixing the metal plate to the insulative housing, a spring arm extending from the base portion and a pressing pad connecting the spring arm for flexibly abutting a side of the electrical element.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
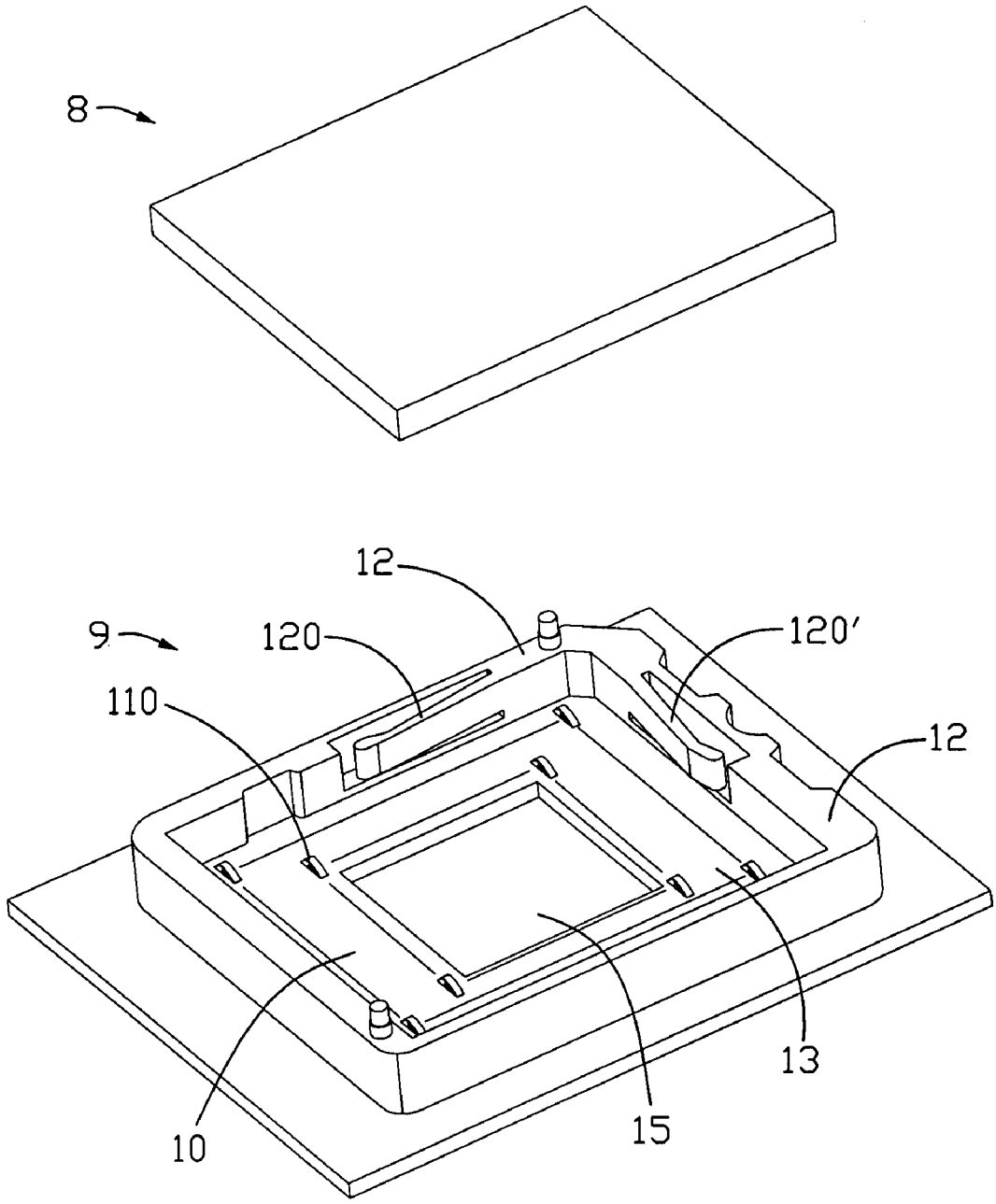
FIG. 1 (PRIOR ART)
FIG. 1 is a perspective view of an electrical connector related to the present invention.

Reference will now be made to the drawing figures to describe the present invention in detail.

Figure 2:
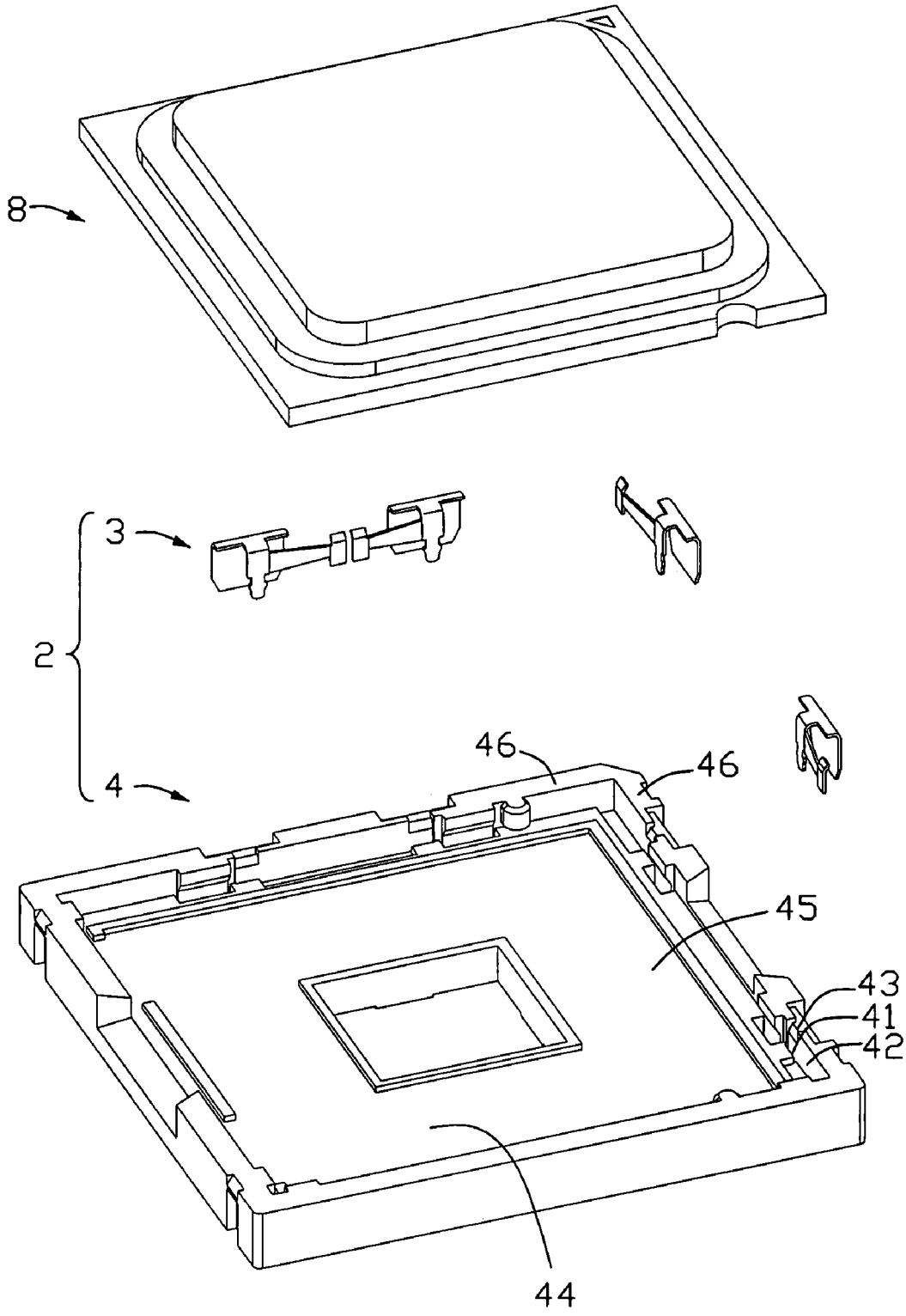
FIG. 2 is an explosive view of an electrical connector according to a first embodiment of the present invention.

As shown in FIG. 2, the electrical connector of the present invention is used for connecting a chipset 8 to a printed circuit board (not shown). The electrical connector 2 includes an insulative housing 4 and four metal plates 3.

The insulative housing 20 forms a bottom floor 45 and four side walls 46 defining a cavity 44 and a opening opposite to the bottom floor 45. Adjacent two of the side walls 46 define sunken portions 42, 43 for receiving the metal plates. The bottom floor 45 defines securing holes 41 for interferentially mating with the metal plates 3.

Figure 3:
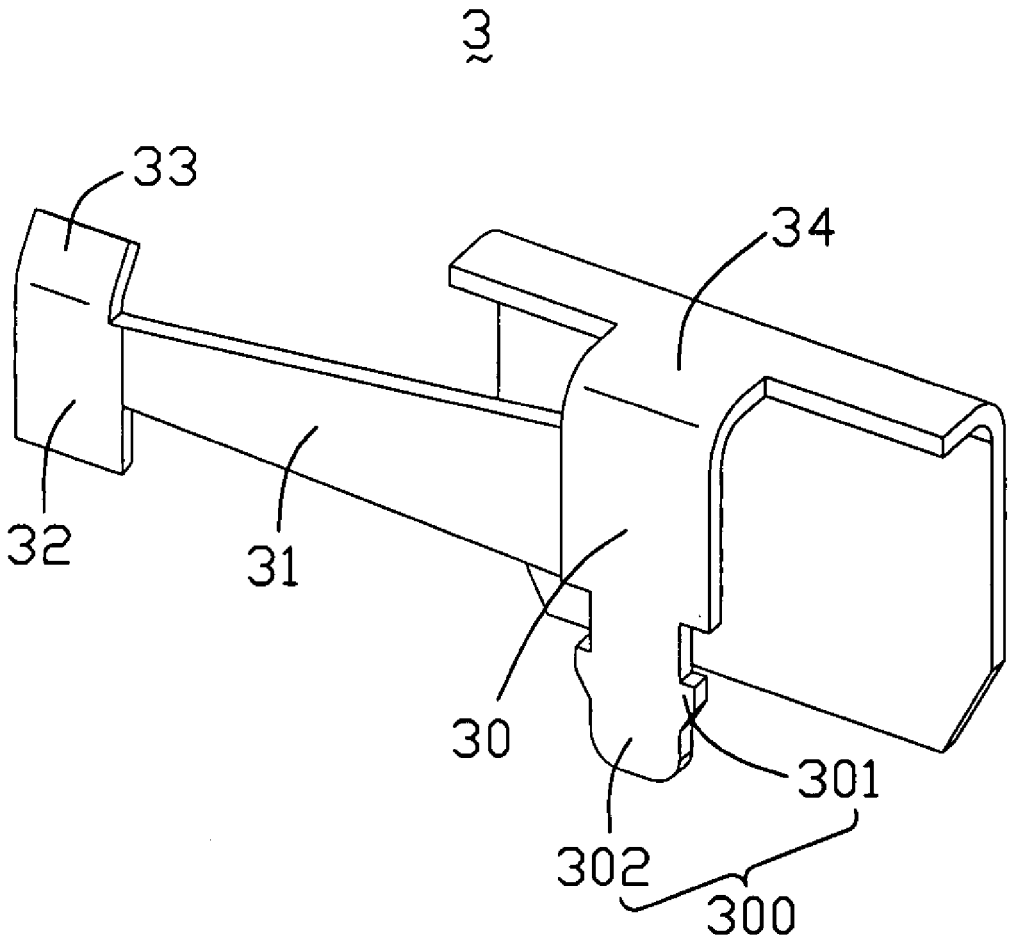
FIG. 3 is a perspective view of a metal plate shown in FIG. 1.
Figure 4:
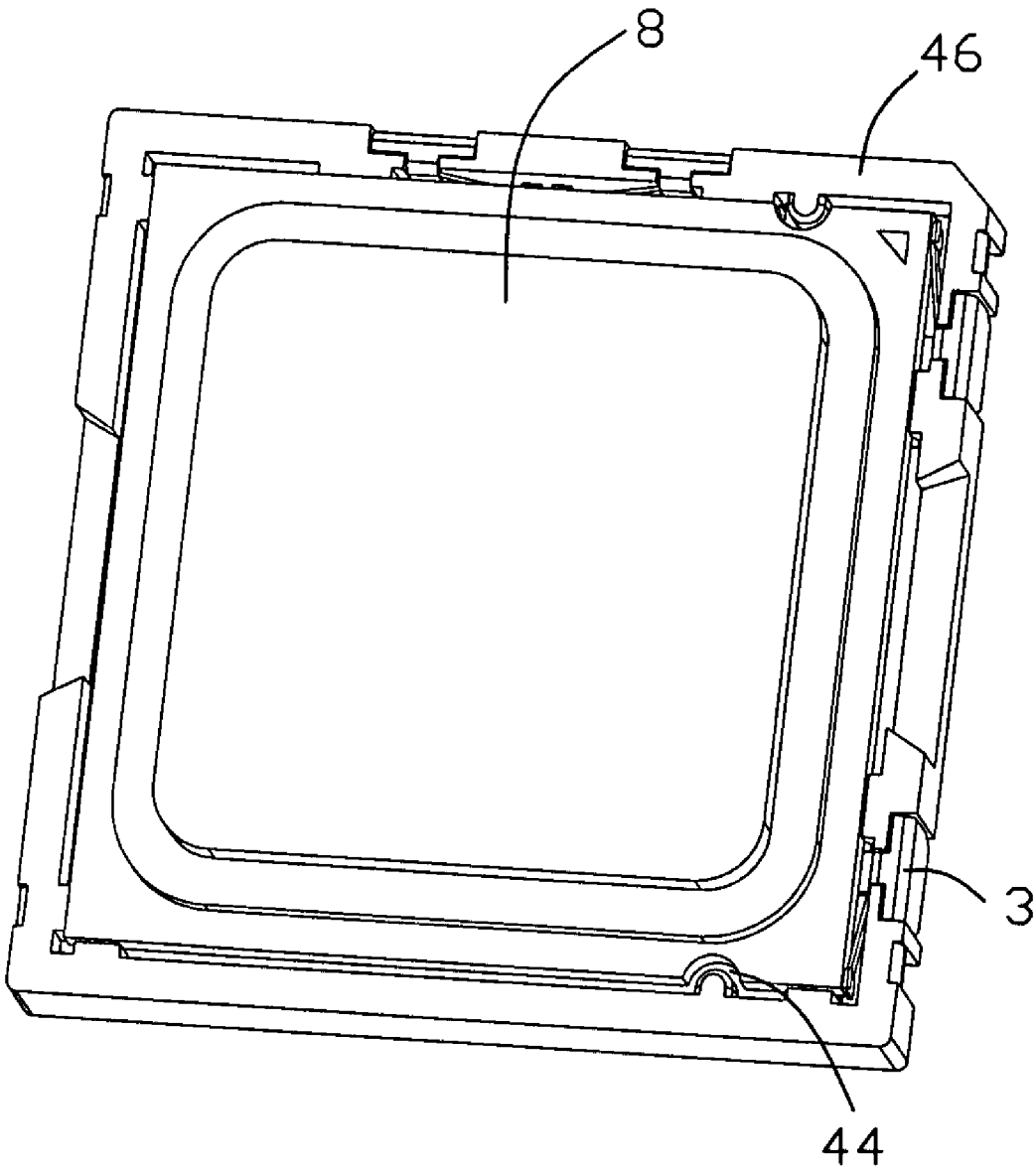
FIG. 4 is a perspective view of the electrical connector shown in FIG. 2, with a chipset received therein.

As shown in FIG. 3, each of the metal plates 30 comprises a base portion 30, a spring arm 31 extending from the base portion 30, a pressing pad 32 connected to a tip end of the spring arm 31 and a guiding portion 33. The base portion 30 further includes a U-shaped clipping portion 34 and a securing portion 300 having a tab 302 and stubs 301.

Since the fatigue strength of the metal is much high than the polymer, so the durability of the metal plate 3 for positioning the chipset 8 in the electrical connector 2 is much better than that of the spring arms 120, 120' of the electrical connector 9. Furthermore, the spring arms 31 are not injection-molded integrally with the insulative housing 4, which makes the insulative housing 4 easy to be injection-molded.

Figure 5:
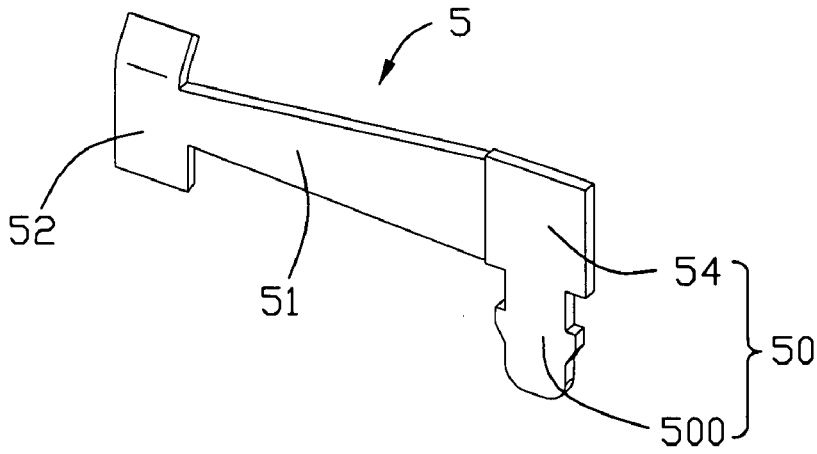
FIG. 5 is a perspective view of a metal plate according to a second embodiment of the present invention.

Referring to FIG. 5, a metal plate 5 forms a base portion 50, a straight spring arm 51 and a pressing pad 52. The base portion 50 further includes a supporting board 54 connecting the spring arm 51 and a securing portion 500 straightly extending from an edge of the supporting board 54.

Figure 6:
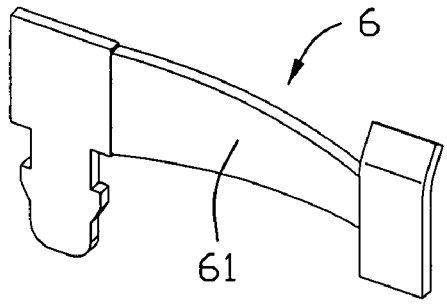
FIG. 6 is a perspective view of a metal plate according to a third embodiment of the present invention.

Referring to FIG. 6, a metal plate 6 according to a third embodiment is similar to the metal plate 5 except that an actuate spring arm 61 substitutes for the straight spring arm 51.

Figure 7:
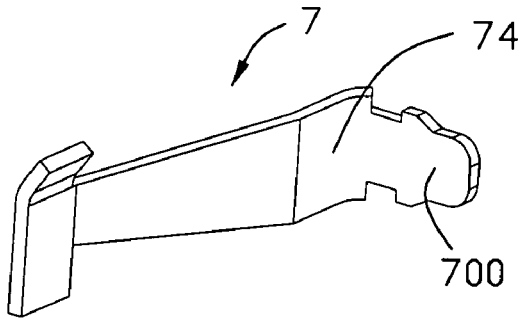
FIG. 7 is a perspective view of a metal plate according to a fourth embodiment of the present invention.

Referring to FIG. 7, a metal plate 7 according to a fourth embodiment is similar to the metal plate 5 except that a securing portion 700 is perpendicularly bent from a supporting board 74.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

I claim:

1. An electrical connector is for connecting an electrical element to a printed circuit board comprising:

an insulative housing having a bottom floor and a plurality of side walls extending perpendicularly from the bottom floor forming in rectangular shape, the bottom floor and the side walls defining a cavity and an opening opposite the bottom floor for receiving the electrical element; and four metal plates mounted in adjacent two of the four side walls; the metal plates being flexibly abutting the electrical element against the sidewalls, each metal plate comprising a base portion fixed to the insulative housing, a spring arm extending from the base portion horizontally with respect to a corresponding side wall into the cavity, a pressing pad vertically connected to a tip end of the spring arm for flexibly abutting a side of the electrical element; and a guiding portion extending from the pressing pad;

the base portions of each metal plate comprises a securing portion interferentially mating into a hole at the bottom floor defined in the insulative housing and a U-shaped clipping portion having a pair of parallel boards for clipping a portion of the side walls; a supporting board extending from the spring arm at one end and extending from a securing portion straightly at another end to be parallely abutting one of the side walls;

the securing portion comprises a tab portion and a plurality of stubs extending sidewise from the tab portion.

2. The electrical connector according to claim 1, wherein the spring arm comprising a straight spring arm.

3. The electrical connector according to claim 1, wherein the spring arm comprising an actuate spring arm.

4. The electrical connector according to claim 1, wherein the securing portion being perpendicularly bent from the supporting board.

5. The electrical connector according to claim 1, wherein the spring arms being not injection-molded integrally with the insulative housing.

6. The electrical connector according to claim 1, wherein the metal plate having a durable strength than the insulative housing.

7. An electrical connector assembly for connecting an electronic package to a printed circuit board comprising:

an insulative housing having a plurality of side walls extending perpendicularly from a bottom wall commonly defining a rectangular receiving cavity therein; the electronic package received in said receiving cavity; the side walls defining an interior face intimately confronting a side edge of the electronic package;

four discrete metallic pieces mounted in adjacent two of the four side walls; the discrete metallic pieces located in a recess and being flexibly abutting the electronic package against the sidewalls; each discrete metallic piece comprising a base portion fixed to the insulative housing, a spring arm extending from the base portion horizontally and abutting against said side edge to impose a force thereon, a pressing pad defining an upward leading section and connected to a tip end of the spring am for flexibly abutting a side of the electronic package; and a guiding portion extending from the pressing pad;

the base portions of each discrete metallic piece comprises a securing portion interferentially mating into the recess formed beside said abutment interior face and offset from said interior face in an outward direction and a U-shaped clipping portion having a pair of parallel boards for clipping a portion of the side walls; a supporting board extending from the spring arm at one end and extending from a securing portion straightly at another end to be parallely abutting one of the side walls;

the securing portion comprises a tab portion and a plurality of stubs extending sidewise from the tab portion.

8. The electrical connector according to claim 7, the metal plate having a durable strength than the insulative housing.

9. The connector assembly as claimed in claim 7, wherein the spring arm comprising a straight spring arm.

10. The connector assembly as claimed in claim 7, wherein the spring arm comprising an actuate spring arm.

11. The connector assembly as claimed in claim 10, wherein said metallic piece further includes a portion facing on an exterior side of the side wall.

12. An electrical connector assembly for connecting an electronic package to a printed circuit board comprising:

an insulative housing having a plurality of side walls extending perpendicularly from a bottom wall commonly defining a rectangular receiving cavity therein; the electronic package received in said receiving cavity; the side walls defining an interior face intimately confronting a side edge of the electronic package;

four discrete metallic pieces mounted in adjacent two of the four side walls; the discrete metallic pieces located in a recess and being flexibly abutting the electronic package against the sidewalls; each discrete metallic piece comprising a base portion fixed to the insulative housing, a spring arm extending from the base portion horizontally and abutting against said side edge to impose a force thereon, a pressing pad defining an upward leading section and connected to a tip end of the spring arm for flexibly abutting a side of the electronic package; and a guiding portion extending from the pressing pad;

the base portions of each discrete metallic piece comprises a securing portion interferentially mating into the recess formed beside said abutment interior face and offset from said interior face in an outward direction and a U-shaped clipping portion having a pair of parallel boards for clipping a portion of the side walls; a supporting board extending from the spring arm at one end and extending from a securing portion straightly at another end to be parallely abutting one of the side walls;

the securing portion comprises a tab portion and a plurality of stubs extending sidewise from the tab portion;

the recess facing an exterior side of the side walls wherein the discrere metallic pieces being located.

13. The electrical connector according to claim 12, the metal plate having a durable strength than the insulative housing.

14. The connector assembly as claimed in claim 12, wherein the spring arm comprising a straight spring arm.

15. The connector assembly as claimed in claim 14, the spring arm comprising an actuate spring arm.

16. The connector assembly as claimed in claim 15, wherein the spring arms being not injected-molded integrally with the insulative housing.

* * * * *